US005241707A

United States Patent [19]

Kato

[11] Patent Number: 5,241,707

[45] Date of Patent: Sep. 7, 1993

[54] SHIRRED PANTS AND PROCESS FOR PRODUCING THE SAME

[75] Inventor: Tall Kato, Tokyo, Japan

[73] Assignees: Tall Kato; Zin Co., Ltd., both of Tokyo, Japan

[21] Appl. No.: 934,365

[22] Filed: Aug. 25, 1992

[30] Foreign Application Priority Data

May 27, 1992 [JP] Japan ..... 4-35325[U]

[51] Int. Cl.[5] ..... A41D 1/06; A41D 27/00

[52] U.S. Cl. ..... 2/79; 2/227; 2/275; 112/262.2

[58] Field of Search ..... 2/67, 75, 80, 79, 69, 2/69.5, 105, 106, 275, 227, 243 R, 243 B, 409; 112/262.1, 262.2

[56] References Cited

U.S. PATENT DOCUMENTS

| | | | |
|---|---|---|---|
| 2,794,187 | 6/1957 | Edelman | 2/275 |
| 2,905,581 | 9/1959 | Maxey | 2/243 R |
| 4,458,363 | 7/1984 | Harvey | 2/227 X |
| 4,773,101 | 9/1988 | Kapp et al. | 2/80 |
| 4,908,247 | 3/1990 | Baird et al. | 112/262.1 |

FOREIGN PATENT DOCUMENTS

| | | | |
|---|---|---|---|
| 837909 | 2/1939 | France | 2/227 |

*Primary Examiner*—Clifford D. Crowder
*Assistant Examiner*—Jeanette E. Chapman
*Attorney, Agent, or Firm*—Stevens, Davis, Miller & Mosher

[57] ABSTRACT

Shirred pants having a shirring on and along the entire length of front and rear centerlines of pant legs have a fancy appearance and an aesthetic effect improved by fine ripples in an adequate number provided over the whole length of the pants by the shirring. Such shirred pants are readily and economically fabricated from four longitudinally extended quarters per pant leg, having an arcuate plane shape with a sideseam of a standard length of the pants or an inseam side of a standard under-crotch length, as a short arc, and with a centerline side of a length ranging 100–160% of the standard length, as a long arc. Front quarters and rear quarters are seamed together, respectively, at the centerline sides, to form front and rear halves of a pant leg which are then shirred along the entire length of the centerline to gather the long arc substantially to the standard length under a tensionless condition. With the thus shirred halves, the pants are made up according to a usual procedure.

2 Claims, 3 Drawing Sheets

SHIRRED PANTS AND PROCESS FOR PRODUCING THE SAME

BACKGROUND OF THE INVENTION

1. Field of the Invention

The present invention relates to trousers, particularly pants having excellent motional function and aesthetic effect, more particularly, an improvement of hitherto known shirred pants, and a process for producing the same.

2. Description of the Prior Art

As pants adapted for wear in skiing, riding, golfing, motorcycling, bicycling or the like, a number of those entirely or partly composed of an elastic fabric for improving motional function thereof have so far been proposed, for example, in Japanese Utility Model Registration Publication Nos. 52-3,818, 56-1,683, 60-6,402, 62-11,923, 62-11,924, etc. Since they require a special elastic fabric and a difficult sewing technique, most of them have had drawbacks such as a high production cost and in addition an increase of wearers' fatigue due to a tight fit exerted to the body by the elastic fabric, rather than a feeling of comfort. Besides, these are mainly a kind of sportswear and not suited for home wear, casual wear or townwear.

Aiming to solve such hitherto posed problems and to provide inexpensive pants of free size, suited for use as home wear, townwear or leisure wear, which give a feeling of comfortable wear without preventing a free and light motion as well as an excellent aesthetic style and are very convenient for handling, I, the inventor, proposed in Japanese Utility Model Registration Application Laid-open No. 63-170,412 shirred pants which have at least 2, preferably 4 shirrings per a pant leg at symmetrical positions with respect to the cross-section of the pant leg, said shirrings extending from the cuff of the pant leg up to the seam line of the self-belt or the crotch of the pants.

In a preferable embodiment of such conventional shirred pants as shown in FIGS. 5 and 6, a front half cloth 21 and a rear half cloth 22 to compose a pant leg are cut out so as to have a length as much as 130–160% of a standard length of the pants and sewn together. Then, four shirrings per one pant leg are provided to the sewn up pants along front and rear centerlines 23 and 24, sideseams 25 and 25 and inseams 26 and 26 to reduce by gathering the length of the pants to the standard size. Though these shirred pants achieved the aimed objects in general on the one hand, the following difficulties were encountered in the stage of actual practices on the other hand.

Namely, since the above-described conventional shirred pants are composed of a trousering much longer than a normal or standard trousering and shirred to form uniform, horizontal ripples over the whole pants, the function of the pants may be rather impaired according to the portion thereof. For example, (a) at a fly front portion, around a slash pocket, or the like, a sewing operation is difficult to conduct due to the shirrings, so that the cloth has to be gathered beforehand at portions where slash pockets, side slits, zippers, zipper shields or fly fronts are provided or sewn up, with a troublesome work taking much time and impairment of aesthetic appearance; (b) further, in the case where a shirring is provided particularly along inseams, a delicate skill is required in adjusting a contracting force of a shirring band, and if it is inadequately adjusted, the crotch portion will become slackened so that the wearer's shape looks awkward; (c) as a whole, one may have an impression that the ripples formed by shirrings are so excessive in number that they are apt to tire of the style; and (d) the necessary length of the fabric must be extremely increased for providing shirrings and it pushes up the cost of production. Furthermore, from the above reasons, many portions which make sewing operations difficult and in addition many shirrings to be provided increase wages for sewing and push up the cost of production.

SUMMARY OF THE INVENTION

An object of the present invention is to easily and economically provide shirred pants having a further improved and aestheticized appearance, without impairing advantage of the conventional shirred pants, and to eliminate the above-described difficulties entailed by the conventional shirred pants. A further object of the present invention is to provide fashionably and variedly designed shirred pants which can be almost released from restrictions with respect of designing and selection of materials, by minimizing the number of the shirrings.

Namely, the present invention is shirred pants comprising a pair of pant legs bordered by a front seam or front placket and a crotch seam, each of said pant legs comprising two outside quarters defined by a front or rear centerline seam and a sideseam, and two inside quarters defined by said front or rear centerline seam, an inseam and the front seam or front placket or the crotch seam, said four quarters having an arcuate plane shape in expanded patterns thereof, which arcuate plane shape has said sideseam of a length corresponding to a standard length of the pants or said inseam of a length corresponding to a standard under-crotch length, as an inside short arc, and said centerline seams of a length ranging 110–160% of the length of said sideseam, as an outside long arc, and which centerline seams are provided with a shirring thereon, along the entire length thereof and gathered by said shirring to an apparent length substantially the same as the length of the sideseam under a tensionless condition.

Further, a process for producing the shirred pants according to the present invention, comprises the steps of:

(a) preparing two sets of pattern fabrics, in a mirror symmetrical relation with one another, of structural materials of a trousering, each set comprising four longitudinally extending quarters of a pant leg, said four quarters being front and rear, outside and inside quarters, each being formed into an arcuate plane shape in its expanded pattern with an inside short arc having a length corresponding to a standard length of the pants, for the outside quarters, or having a standard under-crotch length, for the inside quarters, and with an outside long arc having a length ranging 110–160% of a standard length of the pants;

(b) seaming said front outside and inside quarters and said rear outside and inside quarters at said long arcs, respectively, to form front and rear halves which are provided with a longitudinal centerline seam along the long arc;

(c) providing a shirring on and along the entire length of said centerline seams to gather the centerline seams to have an apparent length substantially the same as the length of the standard length of the pants under a tensionless condition;

(d) combining the thus formed shirred rear half of a pant leg with another similar half in a mirror symmetrical relation therewith at the crotch to form a rear half of the pants; and (e) sewing up a pair of the shirred front halves of pant legs to said rear half of the pants at corresponding short arcs, respectively, to form inseams and outseams.

In this specification and claims, the term "shirring" is meant by gathering of cloth under a tensionless condition that is made by drawing up the cloth along a line of stitching, by stitching the cloth with an elongated elastic control band, such as a rubber thread or the like, under tension.

BRIEF DESCRIPTION OF THE DRAWING

The above and other objects, features and advantages of the present invention will become more apparent from reading the following description of the preferred embodiments taken in connection with the accompanying drawings, wherein.

DETAILED DESCRIPTION OF THE INVENTION

Figure 1:
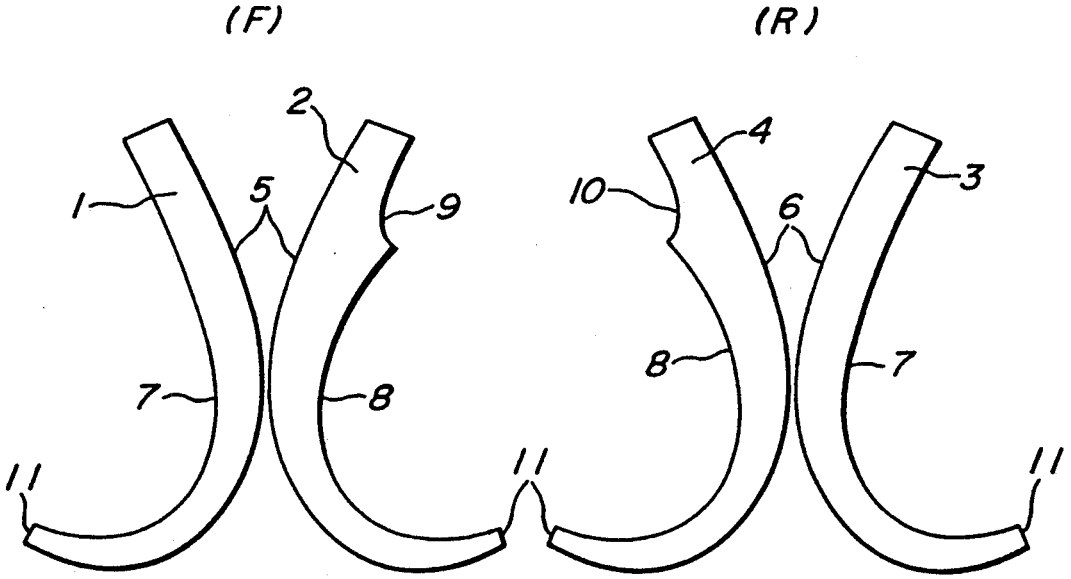
FIG. 1 is a plan view showing an expanded pattern of structural components of the shirred pants according to the present invention.

In FIG. 1 showing an expanded pattern of structural component fabrics of a pant leg of the pants according to the present invention, a front half F and a rear half R of the pant leg are divided along longitudinal centerlines 5 and 6, respectively, into a front outside quarter 1 and a front inside quarter 2 and a rear outside quarter 3 and a rear inside quarter 4. For a pair of pants, two sets of such structural component pattern fabrics in a mirror symmetrical or flip-flop relation with one another are prepared.

These longitudinally extending quarters 1, 2, 3 and 4, as structural components, are formed into an archwise bent shape in plane having a centerline side 5 or 6 as an outside long arc and a sideseam side 7 or inseam side 8 as an inside short arc, in the expanded pattern thereof.

The sideseam side 7 has a length corresponding to a standard length of the pants, namely, an under-belt length of the pants in accordance with a wearer's size. The inseam side 8 has a length corresponding to a standard under-crotch length extending from the lower end of the crotch 10 to a cuff 11 of the pant leg, in accordance with a wearer's size.

Though it depends upon the breadth of the pant leg and the designed elongation and contraction degree of the shirring, a curvature of the bent arcuate shape is determined so that the length of the centerline sides 5 and 6 may be in the range of 110–160% of the length of the sideseam side 7. Within the above range, the bent shape can be arbitrarily designed to be arcuate, a part of an ellipse, parabolic or the like, with the degree of gathering by the shirring appropriately being changed in the longitudinal direction.

Figure 2:
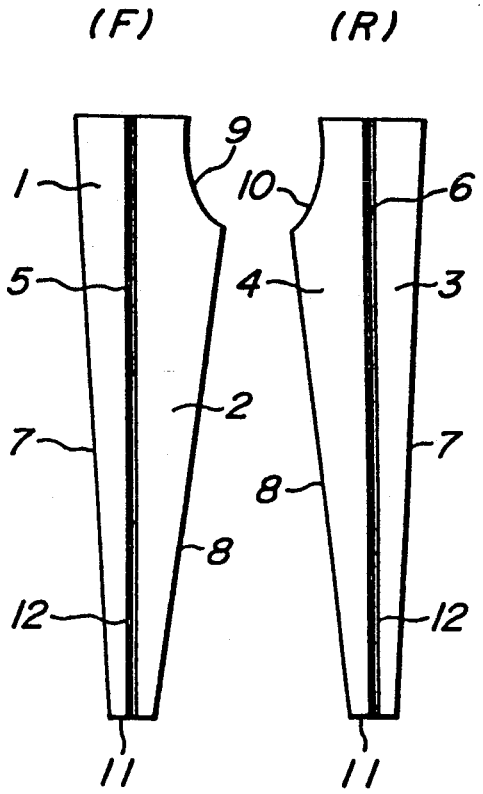
FIG. 2 is a plan view showing front and rear halves of a pant leg, fabricated in the process of manufacturing the shirred pants according to the present invention.

As shown in FIG. 2, the front outside quarter 1 and front inside quarter 2, and the rear outside quarter 3 and rear inside quarter 4, are seamed together at their centerline sides 5 and 6, respectively, to form a front half F and a rear half R of a pant leg and then a shirring 12 is provided on and along the entire length of each centerline 5 or 6 with an elastic control band having a length at contraction so determined as to be substantially the same as the length of the sideseam side 7. The term "substantially the same length" should be noted to include a somewhat different length to the extent that the centerline does not excessively slacken or tense to cause an awkward appearance or impair motional functions of the pants.

Figure 3:
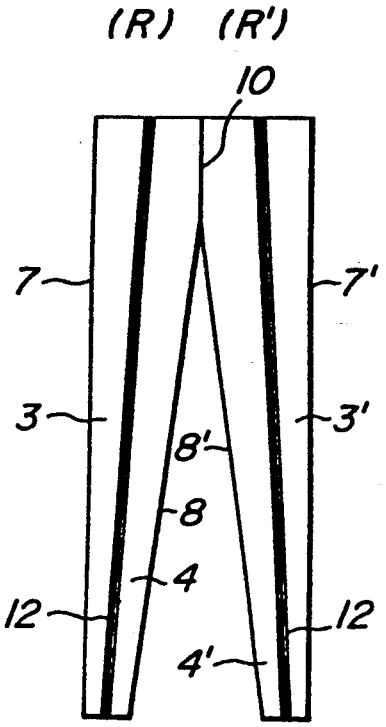
FIG. 3 is a plan view showing a rear half of the shirred pants, fabricated in the process of manufacturing the shirred pants according to the present invention.

As shown in FIG. 3, the thus shirred rear half R of a pant leg composed of the quarters 3 and 4 and another separately formed similar half R' in a mirror symmetrical relation therewith are sewn up together at the crotch 10 to form a rear half of the pants. Then, the shirred front half F of a pant leg composed of the quarters 1 and 2 and another separately formed similar half in a symmetrical relation therewith are sewn up to the front side of the above rear half of the pants, respectively, at corresponding inseam sides 8 and outseam sides 7, into a pair of pants of integral one body. The shirred front halves of pant legs may be either combined at the front seam 9 together or left unseamed to form a front placket to be provided with a fly front or zipper shield, before sewing up to the rear half of the pants.

Figure 4:
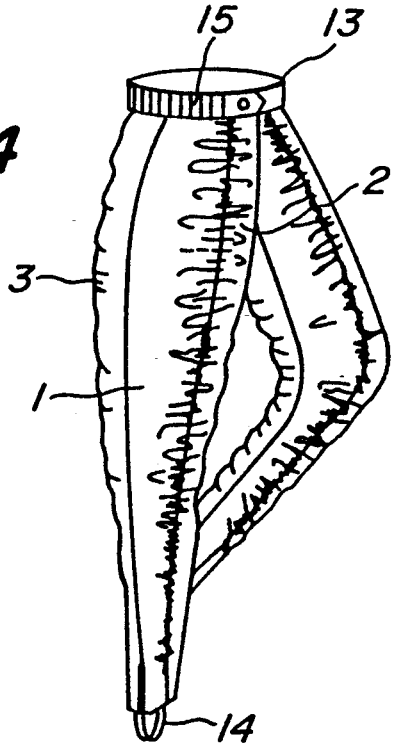
FIG. 4 is a slant view showing made-up shirred pants according to the present invention.
Figure 5:
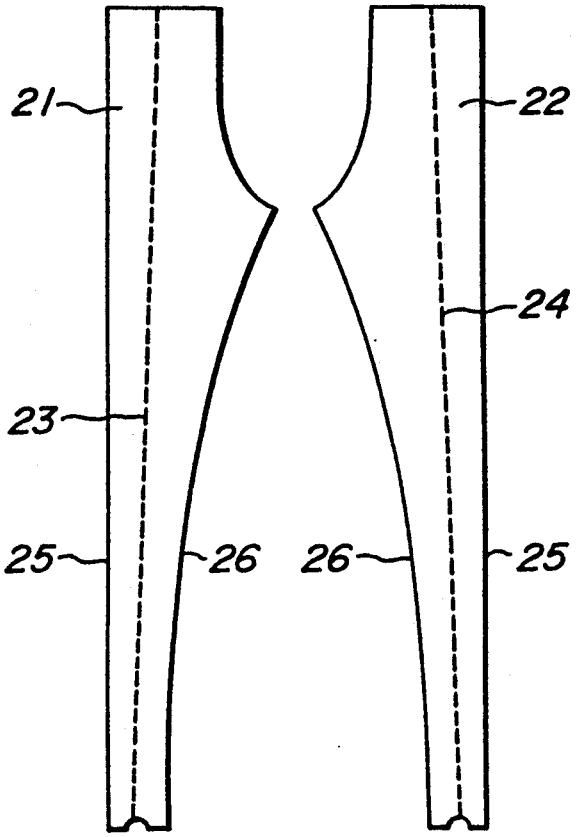
FIG 5 PRIOR ART
FIG. 5 is a plan view showing an expanded pattern of structural components of known shirred pants.
Figure 6:
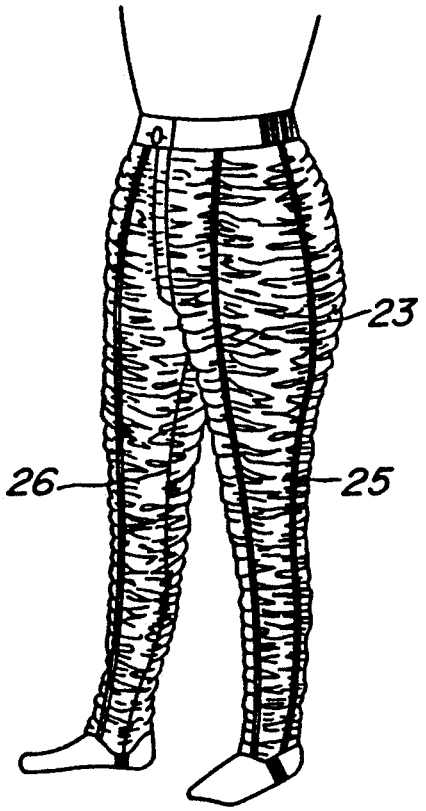
FIG 6 PRIOR ART
FIG. 6 is a slant view showing made-up, known shirred pants.

In FIG. 4, a main body of the pants formed as described above may be then provided with a self-belt 13 and, if required, with straps 14 on the cuffs. It is desired to compose at least a part of the self-belt 13 of an elastic material 15.

The thus made up shirred pants according to the present invention are provided with shirrings continuously extending from the cuffs 11 or the vicinity thereof up to the seamline of the self-belt 13, on and along the entire length of the front and rear centerlines 5 and 6. Since the sideseams, inseams, crotchseam, front seam, etc. are ordinary plain seams without shirring or gathering, these portions can be easily provided with, for example, side zippers on the cuffs, slash pockets or side slits on the both sides of the waist, a zipper shield or fly front on the front placket, or the like, in the same manner as ordinary pants.

As a most preferable example of elastic control bands to be employed in the present invention, mention may be made of a so-called "soft type elastic braid" about 4–8 mm wide, having an appropriate contractile force, which are usually used as a sewing material. An excessively large contractile force may impair motional functions when the pants are put on. On the other hand, if the contractile force is too small, the control band can not contract against stiffness or resilience of the trouserings.

As a structural fabric of the shirred pants according to the present invention, ordinary supple fabrics for pants can be extensively employed, since the number of shirrings is limited to two per a pant leg. It is preferred to use glossy fabrics in view of an aesthetic effect of thereby increased wavy figuration of the fabrics. Further, the use of structural elastic fabrics, such as fabrics woven or knitted with texturized yarns, polyurethane yarns, rubber mixed yarns or the like, having a recoverable stretchability in the warp and/or weft direction(s) can more increase motional functions cooperatively with the configural elasticity of the shirring.

The shirred pants according to the present invention have a very stabilized shape, because they are composed of front and rear, outside and inside quarters which are cut into arcuate shapes and sewn up together, and then provided with shirrings on and along only the centerlines where the longer outer arcs of the outside and inside quarters meet together, and not provided on and along the sideseams, inseams, crotch seam and front seam.

Further, the shirrings continuously extending from the cuffs or the vicinity thereof up to the seam line of the self-belt, on and along the entire length of the front and rear centerlines of the pant legs, serve to form an adequate number of almost uniformly sized, horizontal ripples over the whole length when the pants are put on. Since the shirrings are provided along the entire length of the front and rear centerlines, the shirrings are well balanced with each others and contract to form rather irregular but horizontally oriented ripples.

Furthermore, a relatively supple fabric may make the above ripples more elegant. Alternatively, a glossy fabric may display a gorgeous beauty.

The shirred pants according to the present invention will not impair motional functions such as bending and stretching motions of wearers' legs or waist, or the like, by virtue of an adequate elasticity of the control bands and a configural elasticity of the fabrics supported by the control bands. Further, the shirred pants of the invention will not give a feeling of tight fit to wearers, different from conventional pants composed of only a structurally elastic fabric.

In a preferable embodiment of the hitherto known shirred pants disclosed in Japanese Utility Model Registration Application Laid-open No. 63-170,412, a trousering far longer than a standard trousering is used and provided with 4 shirrings on and along the entire length of the front and rear centerlines, sideseam and inseam per a pant leg and thus uniform, horizontal ripples are excessively formed over the whole pants. In contrast, the shirred pants according to the present invention, since shirrings are not provided on and along the sideseams, inseams, crotch-seam, front seam or the like, can produce a relatively plain fancy, maintaining beautiful ripples adequately decreased in number, by virtue of a cooperative effect of such a properly selected position and a restricted number of the shirrings. Besides, the appearance of the pants is improved by the absence of shirrings on the fly front, crotch and both sides of the legs, so that a longlasting, untiring, aesthetic sense is given.

Further, a fly front on the front placket, slash pockets or side slits on the sides of the waist, cuff zippers and the like which have been difficult to provide on the conventional shirred pants due to obstructive shirrings, can be readily and neatly provided. Thus, restrictions in designing can be eliminated.

The conventional shirred pants have required fabrics as much as 130–160% of fabrics for ordinary pants, while the pants of the present invention are made up from patterns of which a necessary length of the fabric can be extremely decreased as compared with the conventional shirred pants. Thus, the manufacturing cost can be largely decreased with the decrease of the necessary length of the fabric and the number of the shirrings and with an increase in feasibility of the sewing operation.

Since the shirred pants of the invention have no shirrings on and along the inseams and sideseams, particularly on the inseams, a fear of slackening of the crotch portion is eliminated, so that kinds of employable fabrics may be increased and the breadth of the pant legs can be varied.

Furthermore, the shirred pants of the invention can maintain the same meritorious effects and advantages as those of the conventional shirred pants in addition to the above.

Namely, the shirred pants of the present invention, since they are well stretchable and contractible, do not strain even when the wearer crouches, nor impede free and light motions of the wearer. In addition, the pants of the invention may have an effect of extremely reducing wearers' fatigue by virtue of a comfortable wear feeling thereof.

Furthermore, as a free-size articles, the pants of the invention can be worn with ease even by somewhat fat persons insofar as their body shape does not largely deviate from the standard, and create a smart silhouette having the contours of the body blurred by the ripples. Additionally, the pants of the invention have a visual aesthetic effect such that beautiful leg-lines are kept, or bowlegs or knock-knees look normal.

The pants of the invention, different from ordinary pants, are totally free from cares of wrinkling, creasing, pleat flattening or the like, require no ironing and are easy to wash. Further, since they can be carried or laid away by wadding up into a ball, the pants of the invention are very convenient in storage and maintenance, for example, with extremely decreased spaces for storage, no hangers required, or the like.

The shirred pants of the invention are suited for home working wear as home wear or casual wear, and further adapted for extensive applications in loungewear, townwear, leisure wear and the like.

As explained above, the shirred pants of the present invention do not impair advantages of the conventional shirred pants in the least, improve their shortcomings, largely contribute in reducing prices and, therefore, are far superior to the conventional shirred pants.

What is claimed is:

1. Shirred pants comprising a pair of pant legs bordered by a member selected from the group consisting of a front seam and a front placket and by a crotch seam, each of said pant legs comprising two outside quarters defined by a centerline seam selected from the group consisting of a front centerline seam and a rear centerline seam and by a sideseam, and two inside quarters defined by said centerline seam, an inseam and a member selected from the group consisting of said front seam, said front placket and the crotch seam, said four quarters having an arcuate plane shape in expanded patterns, thereof, which said arcuate plane shape has one of said sideseam of a length corresponding to a standard length of the pants and said inseam of a length corresponding to a standard under-crotch length, as an inside short arc, and said centerline seams of a length ranging 110–160% of the length of said sideseam, as an outside long arc, and which centerline seams are provided with a shirring thereon, along which centerline seams are provided with a shirring thereon, along the entire length thereof and gathered by said shirring to a length substantially the same as the length of the sideseam under a tensionless condition.

2. A process for producing shirred pants, comprising the steps of:

(a) producing two sets of pattern fabrics of structural materials for a pair of pants, in a mirror symmetrical relation with one another, each set comprising four longitudinally extending quarters of a pant leg, said four quarters being front and rear, outside and inside quarters, forming each into an arcuate plane shape in its expanded pattern with an inside short arc and an outside long arc having a length ranging from 110–160% of a standard length of the pants, said short arc for the outside quarters having a length corresponding to a standard length of the pants, and said short arc for the inside quarters having a standard under-crotch length;

(b) seaming said front outside and inside quarters and said rear outside and inside quarters at said long arcs, respectively, to form front and rear halves which are provided with a longitudinal centerline seam along the long arc;

(c) providing a shirring on and along the entire length of said centerline seams to gather the centerline seams to have length substantially the same as the length of the standard length of the pants under a tensionless condition;

(d) combining the thus shirred rear half of a pant leg with another similar half in a mirror symmetrical relation therewith at the crotch to form a rear half of the pants;

(e) sewing up a pair of the shirred front halves of pant legs to said rear half of the pants at corresponding short arcs, respectively, to form inseams and outseams.

* * * * *